US009127654B2

(12) United States Patent
Barral et al.

(10) Patent No.: US 9,127,654 B2
(45) Date of Patent: Sep. 8, 2015

(54) HALL EFFECT PLASMA THRUSTER WITH INSULATED LAYERED RING ASSEMBLY

(75) Inventors: Serge Barral, Varsovie (PL); Stéphan J. Zurbach, Vernon (FR)

(73) Assignees: SNECMA, Paris (FR); INSTITUTE OF FUNDAMENTAL TECHNOLOGICAL RESEARCH POLISH ACADEMY OF SCIENCES, Varsovie (PL); CENTRE NATIONAL D'ETUDES SPATIALES, Paris Cedex (FR); CENTRE NATIONAL DE LA RECHERCHE SCIENTIFIQUE, Paris (FR)

( * ) Notice: Subject to any disclaimer, the term of this patent is extended or adjusted under 35 U.S.C. 154(b) by 935 days.

(21) Appl. No.: 13/321,292

(22) PCT Filed: May 19, 2010

(86) PCT No.: PCT/FR2010/050963

§ 371 (c)(1),
(2), (4) Date: Feb. 1, 2012

(87) PCT Pub. No.: WO2010/133802

PCT Pub. Date: Nov. 25, 2010

(65) Prior Publication Data

US 2012/0117938 A1 May 17, 2012

(30) Foreign Application Priority Data

May 20, 2009 (FR) ..... 09 53370

(51) Int. Cl.

| | |
|---|---|
| ***F03H 1/00*** | (2006.01) |
| *H05H 1/54* | (2006.01) |
| *H01J 27/14* | (2006.01) |

(52) U.S. Cl.

CPC ..... *F03H 1/0075* (2013.01); *F03H 1/0062* (2013.01); *H01J 27/143* (2013.01); *H05H 1/54* (2013.01)

(58) Field of Classification Search

CPC . F03H 1/0037–1/0075; F03H 1/0006–1/0093; F03H 99/00; H05H 2001/2462; H05H 1/54; H02K 44/14; H02K 44/10; H02K 44/08; H02K 44/00; B64G 1/405; H01J 2237/0213

USPC ..... 60/202, 203.1; 313/359.1–363.1, 313/231.31–231.71

See application file for complete search history.

(56) References Cited

U.S. PATENT DOCUMENTS 5,892,329 A 4/1999 Arkhipov et al.
6,777,862 B2 * 8/2004 Fisch et al. ..... 313/359.1

(Continued)

OTHER PUBLICATIONS

Diamant, K. D. et al., "Segmented Electrode Hall Thruster," Journal of Propulsion and Power, vol. 22, No. 6, Nov.-Dec. 2006, XP007911038, pp. 1396-1401.

(Continued)

*Primary Examiner* — Phutthiwat Wongwian
*Assistant Examiner* — Alain Chau
(74) *Attorney, Agent, or Firm* — Preti Flaherty Beliveau & Pachios LLP

(57) ABSTRACT

The Hall effect plasma thruster includes a main annular channel for ionization and acceleration that presents an open downstream end, at least one cathode, an annular anode concentric with the main annular channel, a pipe and a manifold for feeding the channel with ionizable gas, and a magnetic circuit for creating a magnetic field in the main annular channel. The main annular channel includes inner and outer annular wall portions delimiting the open end, each of which includes an assembly of juxtaposed conductive or semi-conductive rings in the form of laminations separated by fine layers of insulation.

12 Claims, 2 Drawing Sheets

(56) References Cited

U.S. PATENT DOCUMENTS

| | | | |
|---|---|---|---|
| 2002/0008455 | A1 | 1/2002 | Fisch et al. |
| 2004/0183452 | A1 | 9/2004 | Kornfeld et al. |

OTHER PUBLICATIONS

Fisch, N.J. et al., "Variable operation of Hall thruster with multiple segmented electrodes," Journal of Applied Physics, vol. 89, No. 4, Feb. 15, 2001, pp. 2040-2046.

* cited by examiner

HALL EFFECT PLASMA THRUSTER WITH INSULATED LAYERED RING ASSEMBLY

FIELD OF THE INVENTION

The present invention provides a Hall effect plasma thruster having a main annular channel for ionization and acceleration that presents an open downstream end, at least one cathode, an annular anode concentric with the main annular channel, a pipe and a manifold for feeding the channel with ionizable gas, and a magnetic circuit for creating a magnetic field in said main annular channel.

In particular, the invention provides Hall effect plasma thrusters used for electric propulsion of satellites.

PRIOR ART

The lifetime of Hall effect plasma thrusters is determined essentially by the erosion of the ceramic insulating channel under the effect of ion bombardment. Because of the topography of electric potential in the channel, some of the ions that are created are accelerated radially towards the walls.

The lengthening of missions for telecommunications satellites and the increase in the required plasma ejection speed (in particular for so-called high specific impulse thrusters) require ever-longer lifetimes, which can no longer be provided by conventional ceramics based on boron nitride.

The great resistance to ion bombardment of certain electrically conductive or semi-conductive materials such as graphite theoretically make them ideal candidates for the discharge channel of a Hall effect thruster.

The idea of using conductive materials, and in particular graphite, was investigated in the USA by Y. Raitses et al. (Princeton University). Those studies reveal the advantage of graphite in terms of lifetime, but make no attempt at solving the problem of the loss in efficiency associated with the plasma being short-circuited.

The low efficiencies observed with conductive materials have until now prevented them being in generalized use in the construction of acceleration channels for plasma thrusters.

Thus, the discharge channels of Hall effect thrusters are constituted at present out of uniform insulating ceramic, usually based on boron nitride and silica (BN—$SiO_2$) materials. Boron nitride-based ceramics enable Hall effect thrusters to achieve performance levels that are high in terms of efficiency, but they present high rates of erosion under ion bombardment that limit the lifetime of such thrusters to about 10,000 hours (h) and that also limit their operation at the highest specific impulses.

DEFINITION AND OBJECT OF THE INVENTION

An object of the present invention is to remedy the above-mentioned drawbacks and in particular to increase the lifetime of Hall effect plasma thrusters while maintaining a high level of energy efficiency.

In accordance with the invention, these objects are achieved by a Hall effect plasma thruster having a main annular channel for ionization and acceleration that presents an open downstream end, at least one cathode, an annular anode concentric with the main annular channel, a pipe and a manifold for feeding the channel with ionizable gas, and a magnetic circuit for creating a magnetic field in said main annular channel, the thruster being characterized in that the main annular channel has inner and outer annular wall portions situated in the vicinity of said open end, each of which comprises an assembly of juxtaposed conductive or semi-conductive rings in the form of laminations separated by fine layers of insulation.

Advantageously, each conductive or semi-conductive ring is subdivided into segments arranged as angular sectors and insulated from one another.

Preferably, the segments of each conductive or semi-conductive ring are arranged in a staggered configuration relative to the adjacent conductive or semi-conductive ring segments.

According to a preferred characteristic of the invention, the fine layers of insulation are arranged on all of the faces of a conductive or semi-conductive ring with the exception of the face defining a portion of the inside wall of the main annular channel.

The assembly of conductive or semi-conductive rings may extend over a length of the inner and outer annular walls that is shorter than the total length of the main annular channel.

In a particular embodiment, the conductive or semi-conductive rings are made of graphite, while the fine layers of insulation are made of dielectric material, and in particular of pyrolytic boron nitride.

The thickness of the conductive or semi-conductive rings is of the order of the electron Larmor radius.

Their maximum thickness a is estimated using the following expression:

$$a < \frac{8}{3} r$$

where r is the Larmor radius of the electrons, and using a condition that determines the azimuth cutoff angle:

$$R \cdot \alpha < 5\mathrm{abs}\left(\frac{Ez}{Et}\right) \cdot r$$

with:

- Ez, Et: electric field along the axis and along the azimuth direction;
- R: the edge radius of the ring portion in contact with the plasma; and
- $\alpha$: angle of the ring portion.

In an embodiment, the conductive or semi-conductive rings present thickness lying in the range 0.7 millimeters (mm) to 0.9 mm, while the fine layers of insulation present thickness lying in the range 0.04 mm to 0.08 mm.

According to the invention, a pseudo-insulating discharge channel is made using a stack of rings or ring portions made out of a conductive or semi-conductive material and covered in a fine layer of insulating ceramic.

This enables the lifetime of the thruster to be increased by a factor of 3 to 4 without potential loss of efficiency, providing the structure makes it possible to benefit from the advantages of a low erosion rate of the conductive materials without being subjected to their drawbacks, and providing the channel can behave as an electrical insulator relative to the plasma with the electric currents created in the discharge channel being limited as much as possible.

The invention thus optimizes the structure of Hall effect plasma thruster discharge channels by partitioning conductive or semi-conductive walls into insulated segments of small size, thereby giving rise to a large decrease in the short-circuit current and thus avoiding significant loss of efficiency.

The propulsion of telecommunications satellites is associated with major economic stakes and any improvements that can be applied to Hall effect plasma sources, presently recognized as giving the highest performance for maintaining a satellite on station—are of great interest. The present invention provides a direct response to the trend for the lengthening mission durations expected of geostationary satellites by improving the longevity of Hall effect plasma thrusters.

The present invention can also make it possible to operate thrusters having higher specific impulse (Isp) while conserving a significant lifetime. The invention can thus provide a significant competitive advantage for propulsion by Hall effect plasma thrusters.

BRIEF DESCRIPTION OF THE DRAWINGS

Other characteristics and advantages of the invention appear from the following description of particular embodiments given by way of example and with reference to the accompanying drawings, in which.

DETAILED DESCRIPTION OF PREFERRED EMBODIMENTS

Figure 1:
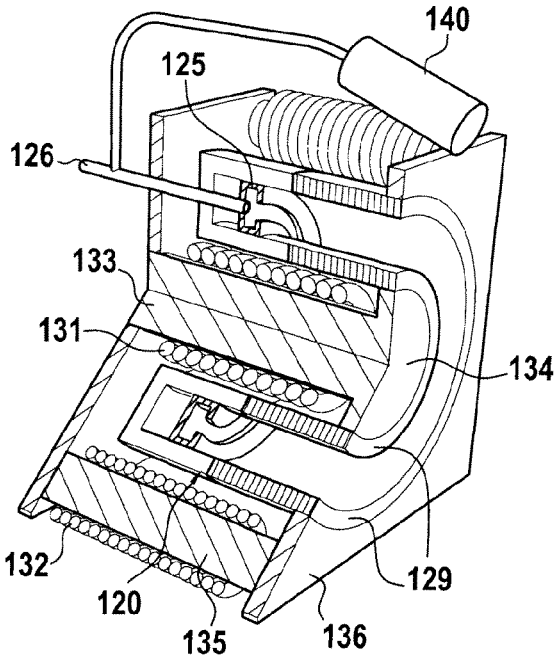
FIG. 1 is a cutaway diagrammatic perspective view of a Hall effect plasma thruster to which the invention is applicable.

FIG. 1 shows an example of a Hall effect plasma thruster, also known as a stationary plasma thruster (SPT), to which the invention is applicable and that can be used in particular for electric propulsion of satellites.

A Hall effect thruster of this type comprises the following main elements:

- a discharge channel or main annular channel 120 for ionizing and acceleration;
- an annular anode 125 concentric with the main annular channel 120;
- a pipe 126 and a manifold associated with the anode 125 and with the main annular channel 120 to feed it with an ionizable gas such as xenon;
- a hollow cathode 140; and
- a magnetic circuit 131 to 136 for creating a magnetic field in the main annular channel.

The anode 125 and the manifold for ionizable gas serves to inject the propellant (such as xenon) into the thruster and to collect the electrons of the plasma discharge.

The hollow cathode 140 serves to generate electrons that are used for creating a plasma in the thruster and also for neutralizing the jet of ions ejected by the thruster.

The magnetic circuit comprises an internal pole 134, an external pole 136, a magnetic yoke interconnecting the internal and external poles 134 and 136 with a central ferromagnetic core 133 and peripheral ferromagnetic bars 135, one or more coils 131 arranged around the central core 133, and coils 132 arranged around the peripheral bars 135.

The magnetic circuit serves to confine the plasma and to create a strong magnetic field E at the outlet from the thruster that enables ions to be accelerated up to speeds of the order of 20 kilometers per second (km/s).

The magnetic circuit may be embodied in other variants and the present invention is not limited to the particular embodiment shown in FIG. 1.

The discharge channel 120 serves to confine the plasma, and its composition determines the performance of the thruster.

Figure 2:
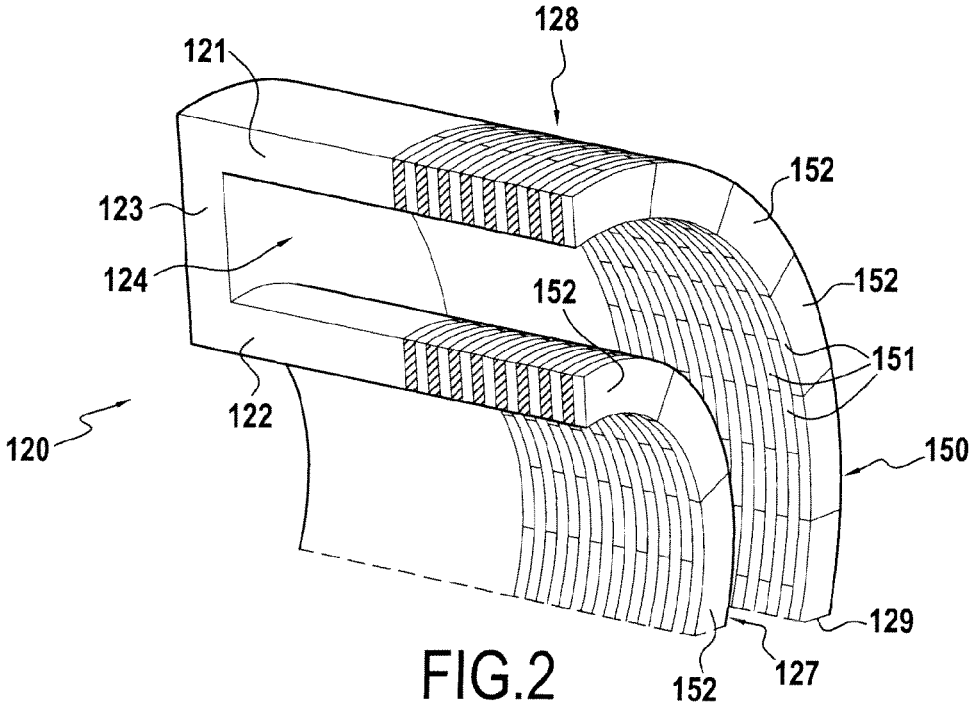
FIG. 2 is a perspective view of one-fourth of a discharge channel of laminated structure in an embodiment of the invention.

Traditionally, the discharge channel 120 is made of ceramic. Engine thrust is provided by ejecting a jet of ions at high speed. Unfortunately, the jet diverges slightly and collisions between high energy ions and the wall of the channel lead to the ceramic being eroded at the outlet from the thruster. That is why, in accordance with the invention, the discharge channel 120 includes at least one portion 127 of the inner annular wall and at least one portion 128 of the outer annular wall, said portions being situated in the vicinity of the open end 129 of the channel, that are not made of solid ceramic, but each of which comprises an assembly of juxtaposed conductive or semi-conductive rings 150 in the form of laminations that are separated by fine layers of insulation 152 (see FIG. 2).

The purpose of the invention is to reduce significantly the erosion of the discharge channel of the thruster. It also serves to reduce the discharge instabilities and energy losses that usually affect Hall effect thrusters making use of a discharge channel made of electrically conductive or semi-conductive material. By making use of materials such as graphite and carbides that are better than ceramics at withstanding ion bombardment, because of the way conductive or semi-conductive rings (e.g. made of graphite) are assembled together while being separated by fine layers of insulation (e.g. of boron nitride), the invention makes it possible simultaneously to reduce the erosion of the channel and also to diminish discharge instabilities.

The discharge channel 120 of a plasma thruster of the invention may thus comprise both a conventional upstream portion made of ceramic having an end wall 123 and outer and inner cylindrical walls 121 and 122, and also a downstream portion situated between the upstream portion and the opening 129 and made up of outer and inner cylindrical walls 128 and 127 having a laminated structure made up of juxtaposed conductive or semi-conductive rings 150 that are insulated by fine layers of insulation 152 but that present a face 151 that is not covered in insulation on the inside facing towards the inside space 124 of the annular channel 120.

Figure 3:
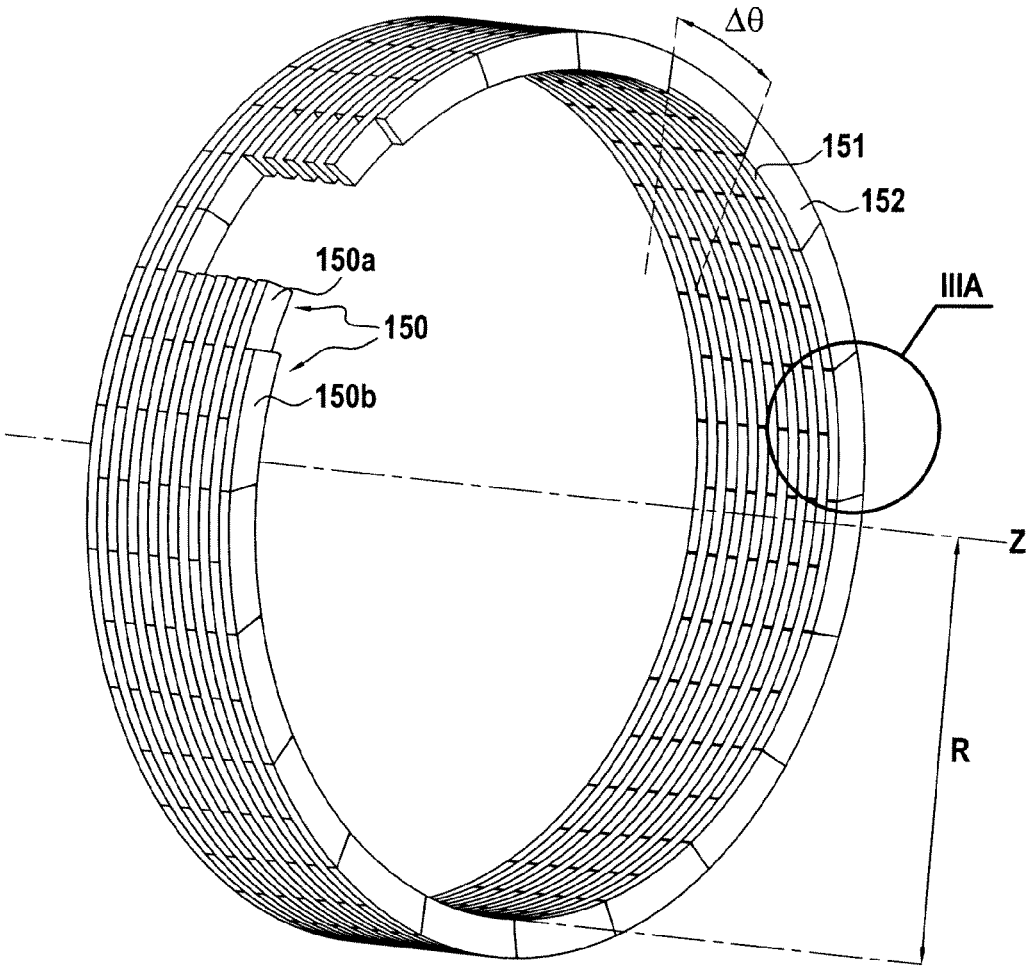
FIG. 3 shows a proposed variant in an overall perspective view of the laminated structure for a discharge channel of a Hall effect plasma thruster of the invention.
Figure 3A:
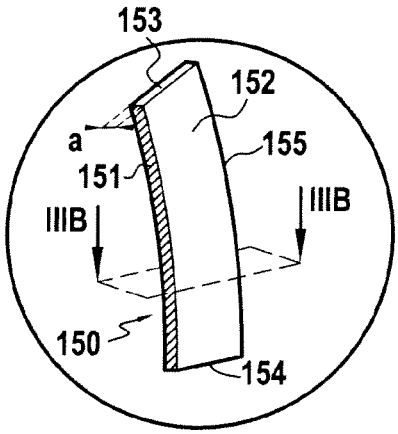
FIG. 3A shows a proposed variant as an enlarged detail view of a segment of conductive or semi-conductive material covered in insulating deposits and used in the laminated structure of FIG. 3.
Figure 3B:
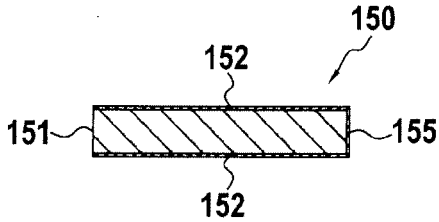
FIG. 3B is a section on line IIIB-IIIB of FIG. 3A.

In order to eliminate potential azimuth short circuit currents induced by potential variations in azimuth (lack of symmetry, azimuth waves, . . . ), it is preferable also to position the rings 150 as a plurality of insulated angular sections, each occupying an angular sector $\Delta\theta$ (FIGS. 3 and 3A). By way of example, there may be ten to 30 segments 150*a*, 150*b* making up each ring 150.

Advantageously, the segments 150*a* of a conductive or semi-conductive ring 150 are in a staggered arrangement relative to the segments 150*b* of the adjacent rings 150 (FIG. 3).

As can be seen in FIG. 3A, the fine layers of insulation 152, 153, 154, and 155 are arranged on all of the faces of a conductive or semi-conductive ring 150 with the exception of the face 151 that defines a portion of the inner wall of the main annular channel 120.

By way of example, the assembly of conductor rings 150 extends over a length of the inner and outer annular walls that lies in the range 20% to 50% and preferably in the range 30% to 40% of the total length of the main annular channel 120, however these ranges of values are not limiting.

The dimensioning of the conductive or semi-conductive rings 150 may be determined by calculating the electron currents that are received and emitted by the walls. To a first approximation, it can be shown that the short circuit current flowing in the walls is proportional to the collected ion current, which, at constant electron temperature and plasma density, is approximately proportional to the conductive area in contact with the plasma.

Furthermore, for a given axial electric field, the potential difference seen by a conductive element is approximately proportional to its axial extent. As a result, for a channel of given size, the total Joule-effect losses due to plasma short circuiting is approximately proportional to the thickness of the rings. It can also be shown that the short circuit current becomes negligible compared with the currents associated with secondary electron emission (which are the only currents that exist when using an insulator), once the thickness of the rings is of the same order as the electron Larmor radius. This defines the critical thickness for the rings that makes it possible to obtain a pseudo-insulating channel.

By way of example, the conductive rings 150, e.g. made of graphite having a small coefficient of expansion, may present thickness lying in the range 0.7 mm to 0.9 mm, typically being 0.8 mm.

The fine layers of insulation 152 to 155, e.g. of pyrolytic boron nitride, may present thickness lying in the range 0.04 mm to 0.08 mm, typically being 0.05 mm, and they may be deposited on the conductive ring segments 150 by a chemical vapor deposition method so as to cover each ring segment over its entire surface with the exception of the edge face 151 that comes into contact with the plasma.

The invention claimed is:

1. A Hall effect plasma thruster having a main annular channel for ionization and acceleration that presents an open downstream end, at least one cathode, an annular anode concentric with the main annular channel, a pipe and a manifold for feeding the main annular channel with ionizable gas, and a magnetic circuit for creating a magnetic field in said main annular channel, wherein the main annular channel has inner and outer annular wall portions delimiting said open end, each of which comprises an assembly of juxtaposed conductive or semi-conductive rings in the form of laminations separated by fine layers of insulation, each of the fine layers of insulation having a thickness smaller than a thickness of said conductive or semi-conductive rings.

2. The plasma thruster according to claim 1, wherein each conductive or semi-conductive ring is subdivided into segments arranged as angular sectors and insulated from one another.

3. The plasma thruster according to claim 2, wherein the segments of each conductive or semi-conductive ring are arranged in a staggered configuration relative to the adjacent conductive or semi-conductive ring segments.

4. The plasma thruster according to claim 3, wherein:

the fine layers of insulation are arranged on all faces of a conductive or semi-conductive ring with the exception of the face defining a portion of the inside wall of the main annular channel;

the assembly of juxtaposed conductive or semi-conductive rings extends over a length of the inner and outer annular walls in the range 20% to 50% of the total length of the main annular channel;

the conductive or semi-conductive rings are made of graphite;

the fine layers of insulation are made of pyrolytic boron nitride; and the thickness of the conductive or semi-conductive rings has a value which is of an order of a value of an electron Larmor radius.

5. The plasma thruster according to claim 1, wherein the fine layers of insulation are arranged on all faces of a conductive or semi-conductive ring with the exception of the face defining a portion of the inside wall of the main annular channel.

6. The plasma thruster according to claim 5, wherein the fine layers of insulation are made of pyrolytic boron nitride.

7. The plasma thruster according to claim 6, the fine layers of insulation present thickness in a range of 0.04 millimeter to 0.08 millimeter.

8. The plasma thruster according to claim 1, wherein the conductive or semi-conductive rings are made of graphite.

9. The plasma thruster according to claim 8, wherein the conductive or semi-conductive rings present thickness in a range of 0.7 millimeter to 0.9 millimeter.

10. The plasma thruster according to claim 1, wherein said assembly of juxtaposed conductive or semi-conductive rings extends over a length of the inner and outer annular walls in a range of 20% to 50% of a total length of the main annular channel.

11. The plasma thruster according to claim 1, wherein the fine layers of insulation are made of pyrolytic boron nitride.

12. The plasma thruster according to claim 1, wherein the thickness of the conductive or semi-conductive rings has a value which is of the order of the value of an electron Larmor radius.

* * * * *